US007676853B1

(12) United States Patent
Cutlip

(10) Patent No.: US 7,676,853 B1
(45) Date of Patent: Mar. 16, 2010

(54) MEN'S UNDERWEAR

(76) Inventor: Ronald S. Cutlip, 393 W. 49th St., Suite 2JJ, New York, NY (US) 10019

( * ) Notice: Subject to any disclaimer, the term of this patent is extended or adjusted under 35 U.S.C. 154(b) by 0 days.

(21) Appl. No.: 11/985,166

(22) Filed: Nov. 13, 2007

(51) Int. Cl.
*A41B 9/00* (2006.01)

(52) U.S. Cl. ..... 2/403; 2/400

(58) Field of Classification Search ..... 2/400–405, 2/67, 228, 238, 227; 602/67–72
See application file for complete search history.

(56) References Cited

U.S. PATENT DOCUMENTS 2,058,970 A * 10/1936 Fiesh ..... 602/67
3,459,181 A * 8/1969 Mann ..... 602/67
4,554,685 A * 11/1985 Ray ..... 2/403
5,070,869 A * 12/1991 Zhang ..... 602/67
5,524,298 A * 6/1996 Plunkett ..... 2/403
5,718,003 A * 2/1998 Gwinn ..... 2/405
6,820,284 B2 * 11/2004 Horikoshi et al. ..... 2/400
6,901,607 B1 * 6/2005 Elwell ..... 2/403
7,065,797 B1 * 6/2006 Chen ..... 2/400
7,178,174 B2 * 2/2007 Soderstrom ..... 2/403

* cited by examiner

*Primary Examiner*—Gloria Hale
(74) *Attorney, Agent, or Firm*—Pryor Cashman LLP; Andrew S. Langsam

(57) ABSTRACT

An article of clothing including a pair of underwear for a male adult comprises a waistband, an underwear section comprising buttocks, hips, and male package covering portions, defining a pair of leg holes therebetween, and a pouch, secured to the rear of the front portion of the waistband and suspended above the bottom of the underwear, the pouch having side edges which inwardly overly the leg holes with the bottom of the pouch tacked to the center of the underwear section. The pouch is preferably provided with a rear edge made from slightly elastic material. The pouch is preferably breathable material, even more preferably made from cotton. The pouch can be integrated into a pair of boxers, briefs, pajamas, etc.

19 Claims, 5 Drawing Sheets

MEN'S UNDERWEAR

BACKGROUND OF THE INVENTION

The present invention relates generally to an article of apparel but, more specifically and in the preferred form, to a pair of men's underwear, a set of boxers or briefs. The invention, however, could be integrated into any article of clothing for a male, including, by way of example and not by limitation, a pair of shorts, sweatpants, running shorts, hospital gown, pajama bottoms, Army fatigues, etc. The present invention is intended to separate and slightly lift a male set of genitalia (the male scrotum and penis are often hereinafter simply referred to as "the male genitalia") from the inside, upper thighs of the male. In this manner, comfort is intended to be maximized in that the separation is expected to increase air circulation, decrease sweating, and thus minimize chafing, rubbing and other discomfort.

DESCRIPTION OF THE PRIOR ART

Men's underwear, whether in brief or boxer form, generally consists of a cloth portion which covers the male genitalia in the front, the hips on the sides, and the buttocks in the rear. Today, most men's underwear is made from cotton or a cotton composition but the present invention is not limited to any particular formulation of cloth, cotton, synthetic, mesh, or natural fiber and extends to any combination or composition of apparel fabric. Today, most men's underwear has an elastic waistband to securely yet comfortable hold the underwear around the man's waist and to allow for expansion and contraction in different positions of wear. A pair of leg holes are provided through which the man's legs extend and the underwear is thus situated to cover and protect the male genitalia, hips, and the buttocks and to separate, for some period of time, the wearer's skin from the over or outer garment, whether that be a pair of pants, shorts, Army fatigues, pajama bottoms, sweatpants, etc.

Today's men's underwear also generally includes a front slanted opening to allow the wearer to easily remove his penis from the underwear (through a front zipper of the outer wear) without the need to remove the underwear so as to allow for urination while standing.

The prior art shows various modifications to men's underwear. Some include a pouch for the male genitalia. However, the modified underwear has not been effective in providing male genitalia with separation nor lift from the inner, upper thighs of the male while simultaneously providing air circulation to the rear and sides of the male genitalia, all while maintaining comfort. The present invention is intended to provide male genitalia with separation, air circulation, and comfort. In this manner, the wearing of men's underwear will become even more comfortable and any irritation, warmth, chafing, etc., especially problematic for those required to wear their underwear for extended periods of time (Army, Marine, policemen, truckers, desk-jobs, taxi drivers, etc.) will be minimized.

U.S. Pat. No. 7,024,703 to Della Ratta, issued Apr. 11, 2006. This patent shows an undergarment with a barrier layer between the groin and the outer wear. Specifically, to promote male fertility, the device has separate holding areas for each of the penis and scrotum and then an area segregating the scrotum from the groin area. The drawings show the invention in various forms. An aperture 16 is provided through the front panel 14 for allowing placement of the male genitalia through the elastic-hemmed portion 18 of the aperture. A special front portion 14 is secured to the front of the brief in lieu of the conventional panel. Also, the fabric is intended to be made of mesh, to promote breathability. An alternate embodiment has the frontal pouch as bifurcated i.e., with a scrotal compartment and a tubular, open ended sleeve, for the penis.

The present invention is expected to be more comfortable to wear for extended times than the prior art conventional men's underwear and does not require the wearer to manipulate and place his penis into a separate cloth-like tube. It is intended by the inventor that the present invention will be readily and easily worn by the current users of ordinary underwear in that no thought at all is required to donning the same in comparison to ordinary, now available underwear. No excessive manipulation of the penis will be required to wear the present invention. Rather, the modified yet fully integrated underwear will be donned and removed just as an ordinary or conventional pair of underwear was donned and removed in the past.

U.S. Pat. No. 6,295,651 to Kang shows an underpants protective structure. There is provided a front piece 11 and a rear piece 12. A pocket piece 13, in a bowl shape, is sewn to the rear piece so that a pocket space is defined by the rear piece 12 and the pocket piece 13. The wearer's scrotum is kept separate from the groin by being received in the pocket space of the pocket piece 13. In addition, a cover piece 14, tubular in shape, has a receiving hole 140 for the wearer's phallus. In use, the wearer's phallus is received in the cover piece 14 by passing through opening 110 and received in the receiving hole 140.

U.S. Pat. No. 5,283,912 to Chung also relates to men's underwear or underpants. While the drawing of FIG. 1 is believed fully informative of the details of the invention disclosed therein, it appears that this device comprises briefs having inner pants with a hole at the front for the male genitalia, a front elastic band 22 with two ends attached to the front of the inner pants, a cover attached to the elastic band for allowing exposure of the male genitalia (when the elastic is pulled down along with the cover) or covering of the same; and a loop between the inner pants and the cover for holding, like a noose, the penis. This does not appear to be comfortable and certainly requires some extra manipulation of the penis, in comparison to the present invention and use of conventional men's underwear.

U.S. Pat. No. 6,289,520 to Page also relates to underpants for a male and a pouch for receiving the male genitalia. As illustrated, a front panel 10 supports the male's genitals. The panel 10 has a first panel portion 16 and a second panel portion 18. Each panel portion has four edges and, yet, as can and should be readily understood, edges 16*c* and 18*c* are attached to one another, thus creating an arcuate seam 20. A pleat 22 is shown (See FIGS. 5 and 6) which combines with the arcuate center seam 20 to create the front panel pouch 10 for the male genitals. The pleat 22 is positioned at the juncture of the perineum and scrotum of the wearer. This device does not accomplish the goals sought to be accomplished by the present invention, namely, slight lifting up and out of the male genitalia from the inner, upper thighs of the male, to promote comfort, breathability, and air circulation, while not requiring any significant new thought nor manipulation to the process of donning a pair of men's underwear. The present invention satisfies these criteria and others.

U.S. Pat. No. 4,759,355 to Thrower and U.S. Pat. No. 5,875,495 also to Thrower relate to male underwear. The device disclosed therein has an element having a "tubular" body portion 12, a front opening 24 (for passing the penis through) and a scrotum-underlying section 22. As can be seen in FIGS. 2 and 4, a male genital-covering front panel 14 is provided. A second waistband 38 is provided at the top of the front panel and is superimposed over the primary waistband of the briefs but provides access to the interior of the pocket/front panel through the upper front area of the garment. Here, too, this is not a teaching of the present invention either when individually considered or even if combined with the other known references. The second Thrower patent, the '495 patent, is substantially the same as the first '355 patent, with the exception of the shape of the front opening for passage of the penis.

U.S. Pat. No. 5,647,065 to Richerson is a male genital-supporting pair of briefs. A garment is provided with a front aperture, through which the male genitalia passes, and that aperture is adjustable by use of drawstrings which are guided in a seamed conduit around the aperture. This is intended to separate the male genitalia from the crotch area, as can be seen in the side view of FIG. 4. A separate piece can be retrofitted to a standard pair of shorts, as seen in FIG. 6, again showing the opening for the male genitalia to pass through, then the opening cinches closed around the genitalia, all to separate the same from the wearer's body.

U.S. Pat. No. 5,237,706 to Nalbandian relates to a male garment with a scrotal pouch. The pouch 14 comprises an anterior panel 16 and a firm, optionally perforated posterior panel 18, provided with an opening 20. The male genitalia passes through the opening such that it is positioned between the anterior panel 16 and the posterior panel 18. The placement, according to the '706 patent, results in the continuous anterior displacement of the scrotum and penis in anatomic relationship with one another while raising them to a more prominent position.

U.S. Pat. No. 4,961,419 to Tribble relates to a pair of men's underwear with a penile envelope. The device is directed toward providing an undergarment for those men having a permanently erect or semi-erect organ and/or a penile prosthesis. The body of the briefs is made preferably from two-way stretchable Lycra® SPANDEX (material. The fly front panel shown in FIG. 1 is for cosmetic purposes only—the fly front panel is removed in FIG. 2, for ease of understanding and illustration. The device is described in detail with respect to the provision of differing thicknesses and softnesses of materials for the respective fabric portions and an interior horizontal slit 36 serves to maintain the prosthetic penis upright. This, too, is not a teaching of the present invention, providing a comfortable separate pouch for slightly lifting the male genitalia upwardly and forwardly, while allowing the male donning the same to do so in a manner quite similar to the manner that the male previously donned ordinary or conventional underwear. The present invention provides comfort, air circulation, reduces rubbing, chafing, etc.

The Webster patent, U.S. Pat. No. 4,870,958, relates to an undergarment with a cup portion adjacent the front of the shorts. The cup is slotted or open in the front to form a first and second partition for positioning in the clefts on either side of the groin of the wearer to prevent chafing. Basically, this appears to be like a combined athletic supporter/jock strap and pair of underwear with an overlayer for side access and an opening for the penis and scrotum to be separated from the skin surface behind the scrotum. While this device may be directed to accomplishing some of the goals sought to be accomplished by the present invention, it does so in an entirely different manner.

While the scope of the invention will be defined by the attached claims, among the other basis of distinguishing the present invention from the prior art devices, either when they are individually considered or even if combined together with one another, is that the present device provides a simple pouch area, a sling or hammock, secured in the front to the elastic waistband, having gently sloped sides for accommodating the wearer's legs and corresponding to the leg holes of the underwear, with a slight arced rear edge, preferably of elastic material, for gently lifting upwardly the male genitalia so as to separate the same from the upper inner thighs of the wearer. In addition, the present invention provides a small length or point of tacking of the base of the pouch to the centrally-located bottom of the briefs, i.e., the center portion of the briefs basically located beneath the perineum of the wearer. This ensures that the device is simple to don, to remove, and that it is comfortable to wear while always satisfying its intended function, namely, comfortable fit, air circulation to reduce heat, chafing and rubbing. The tacking point between the pouch and the centrally-located bottom of the briefs is at the bottom (not the buttocks covering sections) of the underwear and can be covered with an extra piece of covering material to ensure that the tacking point does not become an irritant to the wearer.

SUMMARY OF THE INVENTION

The present invention relates to modification of a pair of ordinary men's underwear, whether of the briefs or boxer style. The present invention can, of course, be integrated directly into any article of wearing apparel for a male, to the extent the clothing is meant to cover the male genitalia. So, as mentioned above, the invention can be integrated into a pair of shorts, a pair of pants, pajama bottoms, a swim suit, hospital bottoms, Army fatigues, running shorts, hunting pants, etc. Basically, however, the preferred embodiment relates to providing a pair of men's underwear with an integrated pouch for comfortably holding and providing a slight lift to the male genitalia separating the male genitalia from the upper, inner thighs. Defining an ordinary pair of men's underwear briefs as having a male genitalia, front covering area, a pair of opposed sides for the hips, a bottom area, and a pair of adjacent buttocks-covering sections, all secured within an elastic waistband, the invention contemplates providing at the front of the underwear a pouch, held at the front of the underwear by securing the pouch to the sides and along the front segment of the body-encircling waistband. Thus, a portion of the pouch is held or secured to the underwear along a length of the front of the wearer's waistband. At the two sides of the segment of the waistband to which the pouch is attached, extending rearwardly, are sides of the pouch which allow the wearer's legs to easily pass thereby and through the leg holes of the otherwise conventional underwear. Then, extending across the rear of the pouch-forming piece of material is a rear edge. This edge can be provided with a slight upward curve (towards its outer ends, i.e., away from the center) and slight elasticity. The underwear, when appropriately donned, has the wearer's legs pass by the sides of the pouch and into the leg holes. The wearer's male genitalia is held in the pouch with the rear of the scrotum held up and in the pouch by the rear edge of the pouch. This pouch, acting like a sling or hammock, serves to slightly lift and forwardly separate the male genitalia from the upper, inside thighs of the wearer, all to provide highly comfortable underwear which allows for air circulation of the male genitalia, reduces chaffing and rubbing, all to the increased comfort and wearability of the article of clothing.

In the preferred embodiment of the invention, the elevational bottom or base of the pouch is directly tacked or sewn to the centrally-located bottom of the underwear (the portion of the underwear extending between the leg holes and, from back to front, extending from where the wearer's anus will be located to below the rear of the scrotum, where it attaches to the torso). The bottom of the underwear basically extends forwardly and rearwardly and is configured to substantially covers the wearer's perineum. The tacking of the base of the pouch to the bottom of the underwear serves to maintain the pouch's central location, ease of donning and removal and to ensure that the placement of the male genitalia within the pouch does not involve unnecessary manipulation. In this manner, the pouch is held in its desired location and the wearer of the underwear apparel can don and remove the same just as he would don and take off a pair of conventional underwear.

In the preferred embodiment, the modified men's underwear is entirely made of cotton, a breathable synthetic material, a blend of cotton and natural and/or synthetic material, wholly natural, wholly synthetic, mesh, etc., all intended to increase the level of comfort in wearing the integrated yet modified underwear.

DETAILED DESCRIPTION OF THE DRAWINGS, THE PREFERRED EMBODIMENT AND THE INVENTION

Figure 1:
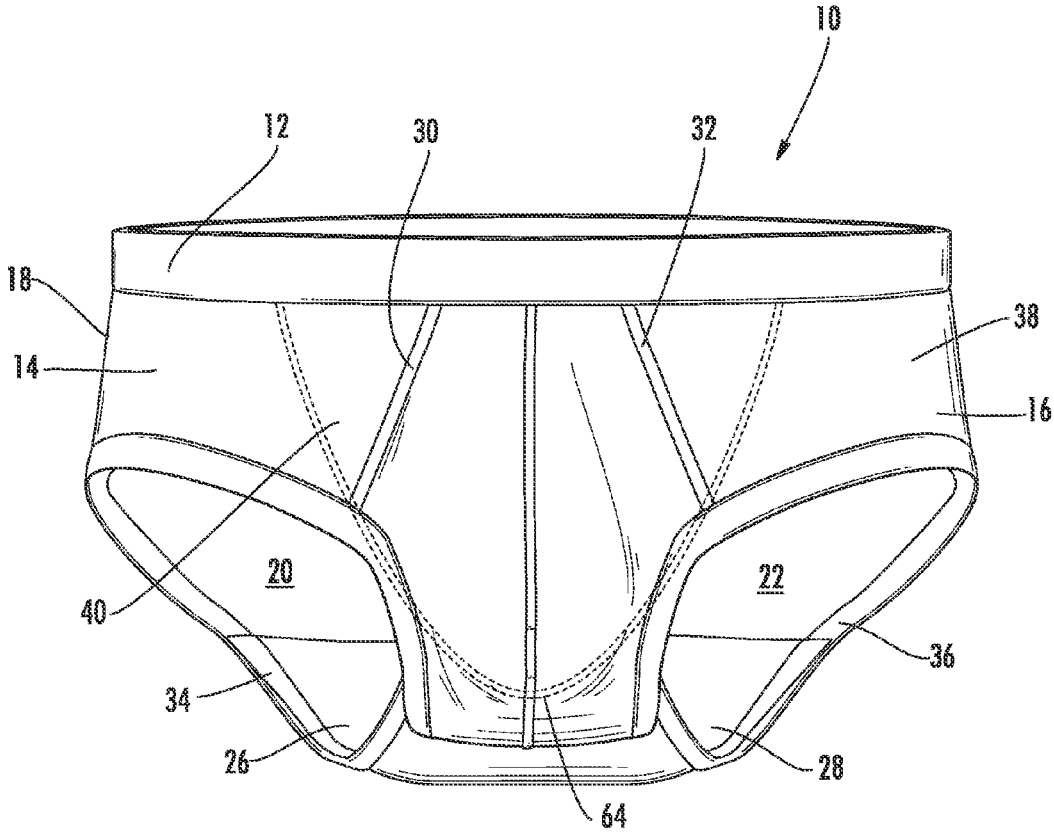
FIG. 1 is a front view of the preferred embodiment of the present invention, a modified pair of men's briefs.

As best seen in the Drawings, a pair of modified male underwear 10 is in the form of a pair of briefs and comprises a seemingly conventional pair of briefs 38, provided with a pouch 40 for holding the male genitalia upwardly and forwardly from the inner, upper, thighs. The briefs are provided with a conventional elastic waistband 12 which will extend around the lower torso of the wearer. The waistband has a front segment, a pair of opposed hip-encircling segments and a rear segment. The waistband has a front, facing outwardly, and an inside, facing towards the center. The length of the waistband when fully extended defines the waist of the wearer while the height of the waistband corresponds to the number of inches that the waistband "sits" on the wearer's waist, extending in the direction of the wearer's height. Generally, the elastic waistband has a height of about ½ of an inch to about 2 inches. The underwear comprises a front cloth section 14 extending across the front and covering the male genitalia and extending from one hip to the other hip of the wearer—a pair of opposed, hip covering areas 16 and 18. The underwear also comprises a bottom section; and a pair of adjacent, buttocks covering areas 20 and 22. The bottom of the briefs typically provide a covering for the area extending between the leg openings and from rear to front, from the anus of the intended wearer to about where the rear point of attachment of the scrotum is to the lower torso, i.e., the bottom of the briefs basically covers the perineum. Typically, the buttocks covering areas are a smooth, continuous piece of fabric and, indeed, the hip covering areas, 16 and 18 are a continuation of the rear section 24. The front cloth section 14 or panel is typically provided with a front, slanted passageway or aperture (not shown) for providing access by the wearer to his penis, for facilitating urination while maintaining the underwear on the torso.

A pair of opposed, separated leg openings, 26 and 28 are provided, too, as conventional with a pair of men's underwear or briefs. The details of the conventional aspects of the briefs are believed fully understood by those of ordinary skill in the area of men's underwear, preferably, boxers and briefs. Thus, for example, the connecting and supporting struts 30 and 32 of the front panel, the elasticity of the waistband 12, the smooth edges 34 and 36 for the leg openings, and the manner of connecting by sewing, if needed, all of the components, are all well-known features of conventional briefs and form no part of the present invention. However, starting from a conventional pair of male underwear with an encircling waistband and integrating therein a pouch consistent with the present invention, a new and innovative article of apparel is described.

Figure 2:
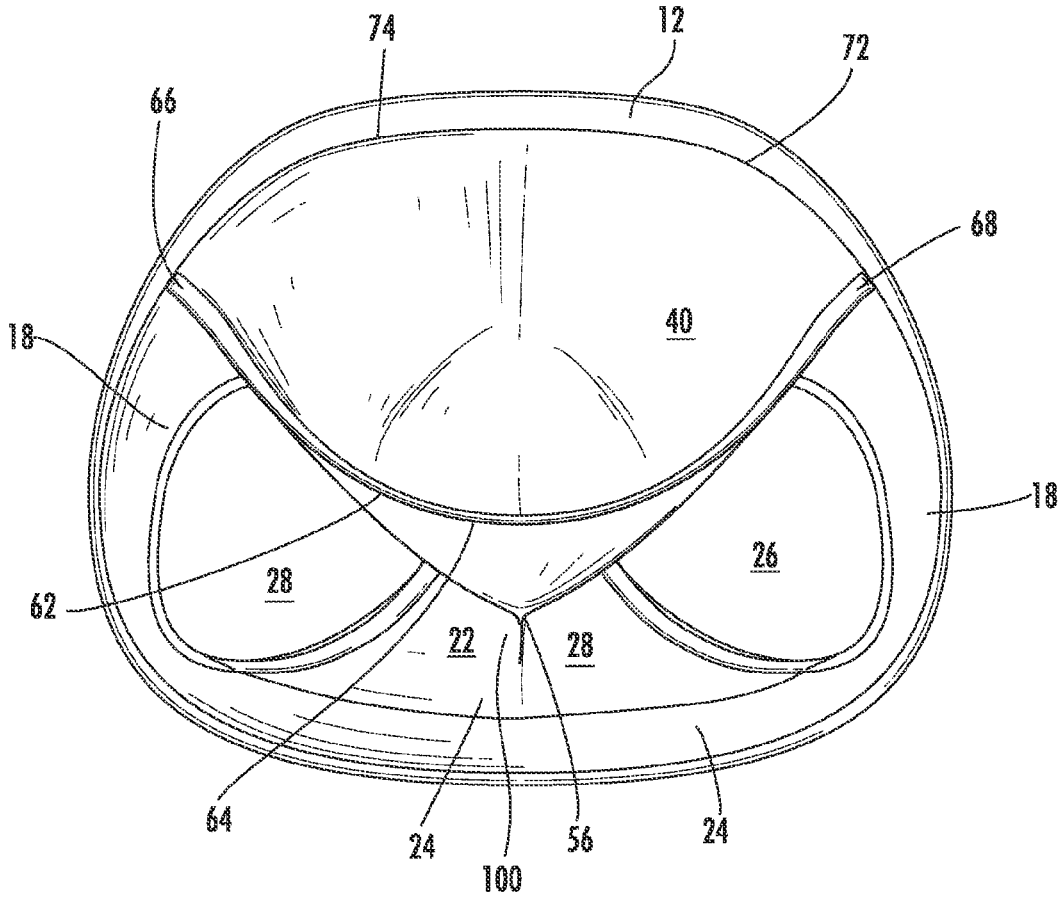
FIG. 2 is a top view of the briefs shown in FIG. 1, i.e., looking downwardly into the briefs as they would appear to a male about to don the same, with the front of the briefs at the top of the Figure.
Figure 3:
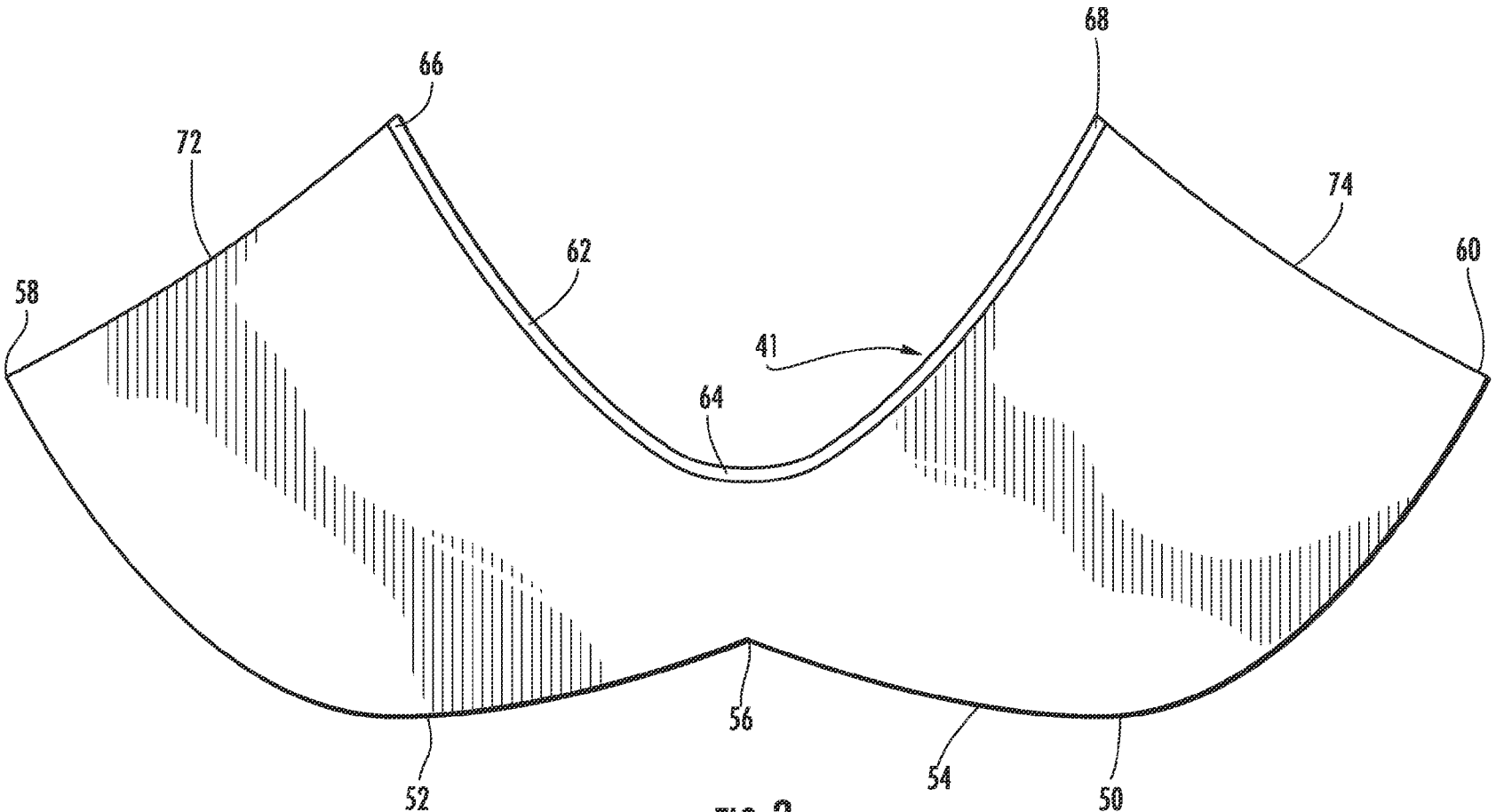
FIG. 3 is a top, plan view of the piece of material or a pattern for making the pouch-like insert which is intended to be sewn into and thus integrated into a conventional pair of briefs to form the present invention.
Figure 4:
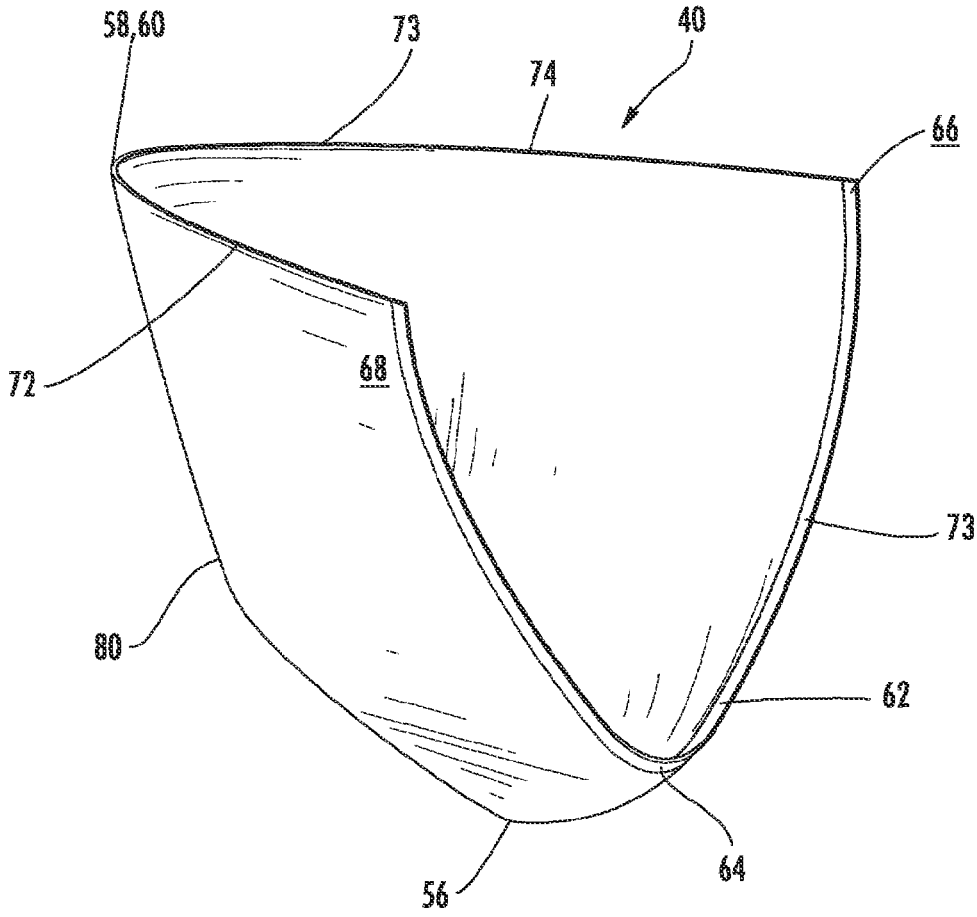
FIG. 4 is a rear, side perspective view of the pouch of the present invention, formed from the piece of material or pattern of FIG. 3, and seamed to form a pouch insert, intended to be sewn into and integrated into a conventional pair of briefs or underwear, as shown in FIGS. 1 and 2, in the preferred embodiment.
Figure 5:
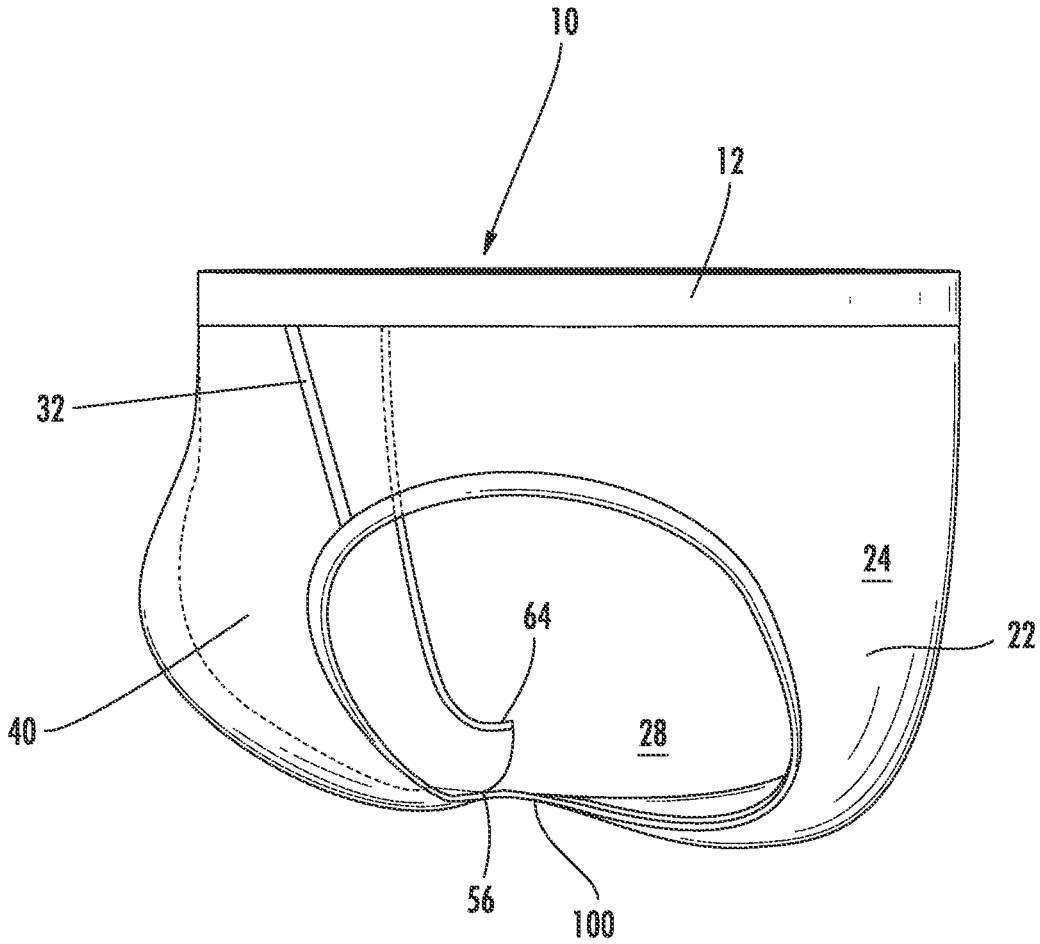
FIG. 5 is a side elevational view of the preferred embodiment of the present invention, a modified pair of men's underwear or briefs, as shown in FIGS. 1, 2 and 4, and showing the base of the pouch tacked or sewn to the centrally-located bottom of the briefs (the bottom basically covering the perineum of the wearer) with the rear, upwardly curved or arched edge of the pouch (preferably at least partially elastic) for the male genitalia located above the bottom of the underwear. The base of the pouch, however, according to the preferred embodiment is tacked or sewn to the centrally-located bottom of the underwear, at a point corresponding to cover the perineum of the wearer, i.e., the bottom extends between the leg openings, from side to side, and from back to front, covers the anus and projects forwardly to a position below where the rear of the scrotum is secured to the lower torso of the wearer.

As seen in FIGS. 2, 4 and 5, the underwear 10 is provided with a pouch 40 for the male genitalia. The pouch 40 is preferably formed from a single piece of fabric, cut from a larger piece of fabric, with the basic pattern or flat shape being shown in FIG. 3. The material for the pouch, like the underwear to which it is attached and secured, is preferably breathable but surely comfortable fabric, whether of cotton, another natural fiber, a synthetic, or a blend of those apparel fibers or materials. The pattern for the preferred perimeter of the pouch is shown in FIG. 3. Once cut from a larger piece of fabric, the pouch is folded in half about the line connecting point 64 and apex 56 (See FIG. 3) and then seamed along curved edge 50, thereby bringing together curve sections 52 and 54, from common apex 56 to respective outer points 58 and 60 (when flat but becoming sewn together when the pouch is formed). This center seam is not shown in FIG. 2, as the preferred embodiment will have the center vertical line of the pouch substantially smooth so as not to provide discomfort to the wearer.

Seaming the curve sections together 52 and 54, as indicated, creates a pouch-like device and the pouch is defined by a back edge 62 having a mid-point or center 64. Distal ends 66 and 68 are located at the far points of back edge 62 and define, along with outer points 58 and 60 (now seamed together), a front wall 73 of the pouch 40. This front wall 73 is secured to the rear side or inside of the front segment or portion of the waistband 12 and extends from distal ends 66 and 68, to common outer points 58 and 60 (common in that they are now seamed together), along front wall segments 72 and 74. Front wall 73, comprised of front wall segments 72 and 74, is sewn to the rear side or the inside of the front segment of the elastic waistband, extending between distal ends 66 and 68 of the pouch (as seen in FIG. 2). The distal ends 66 and 68 of the pouch will be sewn to a portion of the respective opposed segments of the waistband, corresponding to the hips (preferably the front of the hips) of the waistband (See FIG. 2).

Preferably, the back edge 62 of the pouch 40 is provided with slight elasticity (at least a portion can be provided with an enclosed elastic band segment) and, yet, the back edge is preferably of double fabric thickness for comfort. The elasticity serves to support, as will be understood, the scrotum, at the base of the same and serves to slightly elevate the male genitalia above and forwardly towards the front of the underwear, away from the inner, upper thighs of the wearer.

Once the pouch 40 is cut from fabric, as mentioned, folded so that the curve sections 52 and 54 are seamed together, it can be installed by the manufacturer so that the end product is a fully integrated pair of underwear with a pouch for the male genitalia. The seaming brings together original outer points 58 and 60 of the piece shown in FIG. 3, with curve sections 52 and 54 overlying one another. The newly formed common edge 80 (See FIG. 4) is the front vertical midline of the pouch. The distal ends 66 and 68 of the pouch and the front wall segments 72 and 74 are secured to and integrated with the rear or inside of a front length or forward segment of the waistband of the underwear extending from the forward part of the waistband (overlying the wearer's abdomen) to the underwear's sides or hip-covering section, i.e., across the front of the underwear and to the opposed hip areas of the wearer. Thus, starting from point 66 along front wall segment 74, through common outer points 58 and 60, and then continuing with front wall segment 72, terminating at point 68, the pouch is secured to the back or rear side of the front segment of the waistband 12 and extends to the hip segment of the waistband. This secures the pouch and integrates the same into the underwear. The front wall segment 74 of the pouch is "continuous" in that it is uninterrupted between its ends or distal points 66 and 68.

A rear or back edge 62 extending from distal ends 66 and 68 defines the opening, from the rear for the pouch, for the male genitalia. The base, bottom or apex 56 of the pouch is preferably tacked, sewn or otherwise secured to the bottom, centrally-located part of the underwear 100. The bottom 100, a central part of the underwear, basically corresponds to the thin cloth piece of material extending between the leg openings 26 and 28 and covering the perineum of the wearer, i.e., the anatomical portion extending between the rear attachment point of the scrotum to the torso and the anus. The center 64 of the back or rear edge 62 of the pouch 40 is elevated above and slightly rearwardly with respect to the bottom 100 of the underwear by a distance which is related to the distance between apex 56 and center 64 of the rear edge 62. This can be seen in FIGS. 2, 4 and 5.

The underwear is made by manufacturing the pouch from fabric and the more conventional portion of the briefs from a piece of the same or different fabric. Then, the pouch is seamed, as previously described, from common or outer points 58 and 60 through apex 56. The front edge of the pouch, extending from distal end 66 though front wall segment 74, common points 60, 58, front wall segment 72 and terminating at distal end 68, is sewn or secured to the rear side of the front segment of the elastic waistband 12. Thus, the complete, integrated underwear and pouch is formed and preferably takes the form shown in FIGS. 1, 2, and 5.

In use, the wearer dons and removes the underwear just as a conventional pair of underwear, by placing his legs, one at a time, through the corresponding leg holes 26 and 28. Then, the waistband 12 is lifted so that the male genitalia naturally and gently is glided and guided into the pouch 40. The waistband is lifted until the wearer's legs fully pass through the leg holes and the waistband is caused to rest upon the wearer's hips. If needed, the male genitalia can be easily adjusted or moved so that the penis and scrotum are placed over the rear edge 62 and into the pouch 40. As mentioned, however, the design is believed to allow for the male genitalia to naturally slip into the pouch a function of the location of the male genitalia and the pouch and as a consequence of the gently upwardly turned rear edge, with the slight elasticity allowing for ease of donning and, yet, preventing inadvertent removal of the male genitalia. With the underwear on the wearer's body and the male genitalia in the pouch, a gently forward and upward lift is provided by the pouch to the male genitalia. In this manner, the male genitalia is forwardly and upwardly drawn from the inner, upper thighs of the wearer. This is intended to result in more comfort to the wearer, less rubbing, chafing, increased air circulation and less localized "hot spots."

Removal of the underwear is conventional. The slight elasticity of the rear edge of the pouch allows for ease of removal of the male genitalia from the pouch and, in this manner, the underwear is removed merely by sliding the waistband down to below the wearer's knees and then by stepping out of the leg holes, one at a time, just like with conventional underwear. No special laundering is believed to be necessary but, rather, the underwear, except for increased comfort, can be worn, removed and laundered just as conventional underwear.

The invention has been described using exemplary preferred embodiments. However, it is to be understood that the scope of the invention is not limited to the disclosed embodiments. On the contrary, it is intended to cover various modifications and similar arrangements, to the extent covered by the claims of the patent, as interpreted literally and by resort to the Doctrine of Equivalents, as allowed by the Courts.

I claim:

1. An article of clothing for the lower torso of a man comprising:

a) a lower torso covering portion defining buttocks-, hips-, bottom- and male genitalia-covering sections, said sections defining a center line and a pair of opposed leg holes, one on each side of said center line for the wearer's legs, the lower torso covering portion being provided with a continuous, lower torso encircling elastic waistband comprising a front segment; a pair of opposed side segments and a rear segment;

b) a male genitalia-holding pouch having a front horizontal edge held directly to a the inside of said front segment of said waistband and extending to said opposed side segments, a pair of opposed side edges proximal to said leg holes and extending downwardly from the distal ends of said horizontal edge towards said buttocks-covering section and meeting at a rear and elevated, with respect to said bottom-covering section, upwardly curved back edge; and c) the base of said pouch, located in front of but below said curved back edge being point tacked and held to said bottom-covering section.

2. An article of clothing as claimed in claim 1 comprising a pair of men's underwear.

3. An article of clothing as claimed in claim 2, wherein said men's underwear is a pair of briefs.

4. An article of clothing as claimed in claim 2, wherein said men's underwear is a pair of boxers.

5. An article of clothing as claimed in claim 1, wherein said article is a pair of pants.

6. An article of clothing as claimed in claim 1 wherein said front horizontal edge is substantially the same height as and is integrated to said waistband.

7. An article of clothing as claimed in claim 6 wherein said opposed side edges of said pouch extends between the hip-covering sections.

8. An article of clothing as claimed in claim 1 wherein at least a portion of said curved rear edge of said pouch is slightly elastic.

9. An article of clothing as claimed in claim 1 wherein said pouch is made from cotton material.

10. An article of clothing as claimed in claim 1 wherein said pouch is made from a lightweight and breathable material.

11. An article of clothing as claimed in claim 1 wherein, said pouch is elevated and extends slightly upwardly, forwardly and away from the buttocks- and bottom-covering sections.

12. An article of clothing as claimed in claim 1 wherein said pouch and said lower torso covering portion are made from the same material as one another.

13. An article of clothing as claimed in claim 1 wherein said pouch and said lower torso covering portion are made from different materials from one another.

14. An article of clothing for an adult male, comprising a conventional underwear section and an inner pouch, said underwear section comprising:

a) a waistband; buttocks-, hips-, bottom-, and frontal-genitalia covering portions, and a pair of leg holes separated by-a centerline of said buttocks- and bottom-covering portions; said waistband comprising a front segment; a pair of opposed side segments; and a rear segment thereby defining a substantially continuous waistband;

b) said pouch comprising a continuous piece of comfortable fabric and defined by a front, longitudinally extending segment secured along said front segment of said waistband and extending to said opposed side segments, a base point, a pair of opposed downwardly sloped side edges, extending from said opposed side segments of said waistband, which are elevated with respect to said base point and located substantially inwardly with respect to said buttocks- and hip-covering portions and suspended over said leg holes; said opposed side segments defining a rear upwardly curved back edge, said rear upwardly curved back edge having at least a central segment of elasticity, said base point of said pouch being tacked to said bottom-covering portion on said centerline to thereby upwardly and forwardly suspend said pouch above said bottom- and forwardly of said buttocks-covering portions.

15. An article of clothing for an adult male as claimed in claim 14 wherein said article of clothing is integrated into a pair of pants.

16. An article of clothing for an adult male as claimed in claim 14 wherein said underwear section is in the form of a pair of men's briefs.

17. An article of clothing for an adult male as claimed in claim 14, wherein said underwear section is in the form of a pair of men's boxers.

18. An article of clothing for an adult male as claimed in claim 14, wherein said pouch is made from breathable material.

19. An article of clothing for an adult male as claimed in claim 14, wherein said pouch is tacked to said centerline of said bottom-covering portion for a distance of more than a single point.

* * * * *